US011965397B2

(12) United States Patent
Helms

(10) Patent No.: US 11,965,397 B2
(45) Date of Patent: Apr. 23, 2024

(54) OPERATING SLEEVE

(71) Applicant: Halliburton Energy Services, Inc., Houston, TX (US)

(72) Inventor: Lonnie Carl Helms, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/869,361

(22) Filed: Jul. 20, 2022

(65) Prior Publication Data

US 2024/0026754 A1 Jan. 25, 2024

(51) Int. Cl.
*E21B 34/14* (2006.01)
*E21B 33/14* (2006.01)
*E21B 33/16* (2006.01)

(52) U.S. Cl.
CPC ..... *E21B 34/142* (2020.05); *E21B 33/146* (2013.01); *E21B 33/16* (2013.01)

(58) Field of Classification Search
CPC .... E21B 23/04; E21B 23/0413; E21B 33/146; E21B 33/16; E21B 34/14; E21B 34/142
See application file for complete search history.

(56) References Cited

U.S. PATENT DOCUMENTS 3,451,476 A * 6/1969 Pitts ..... E21B 33/146 166/318
3,527,297 A * 9/1970 Todd ..... E21B 34/142 166/318
3,789,926 A 2/1974 Henley et al.
3,811,500 A * 5/1974 Morrisett ..... E21B 34/14 166/153
3,948,322 A 4/1976 Baker
4,260,017 A * 4/1981 Nelson ..... E21B 34/14 166/318
4,487,263 A * 12/1984 Jani ..... E21B 33/16 166/194
4,655,247 A * 4/1987 Westra ..... E21B 21/10 251/368
4,674,569 A * 6/1987 Revils ..... E21B 34/14 166/318
5,024,273 A * 6/1991 Coone ..... E21B 33/127 166/383
5,279,370 A 1/1994 Brandell et al.
5,368,098 A * 11/1994 Blizzard, Jr. ..... E21B 33/146 166/387

(Continued)

FOREIGN PATENT DOCUMENTS

EP 1262629 A1 12/2002

OTHER PUBLICATIONS

Halliburton Catalog titled "Casing Equipment" (2015), entire catalog.

(Continued)

*Primary Examiner* — Jennifer H Gay
(74) *Attorney, Agent, or Firm* — McAfee & Taft

(57) ABSTRACT

A downhole apparatus has a sleeve body sleeve body defining a sleeve body inner surface. The sleeve body has an internal thread on at least a portion thereof. The internal thread defining having a thread minor diameter. A plug seat is pressed into the threaded portion of the sleeve body. The plug seat has an unthreaded outer surface defining a plug seat outer diameter. The plug seat outer diameter is greater than the thread minor diameter.

16 Claims, 11 Drawing Sheets

(56) References Cited

U.S. PATENT DOCUMENTS

| | | | | |
|---|---|---|---|---|
| 5,411,095 | A | 5/1995 | Ehlinger et al. | |
| 5,443,124 | A | 8/1995 | Wood et al. | |
| 5,647,434 | A | 7/1997 | Sullaway et al. | |
| 5,765,641 | A | 6/1998 | Shy et al. | |
| 6,026,903 | A | 2/2000 | Shy et al. | |
| 6,244,342 | B1 | 6/2001 | Sullaway et al. | |
| 6,425,442 | B1 | 7/2002 | Latiolais, Jr. et al. | |
| 6,796,377 | B2 | 9/2004 | Butterfield, Jr. et al. | |
| 6,802,373 | B2 | 10/2004 | Dillenbeck et al. | |
| 7,237,611 | B2 | 7/2007 | Vincent et al. | |
| 7,857,052 | B2 | 12/2010 | Giroux et al. | |
| 7,866,402 | B2 | 1/2011 | Williamson, Jr. | |
| 8,215,404 | B2 | 7/2012 | Makowiecki et al. | |
| 8,496,051 | B2 * | 7/2013 | Cejero | E21B 21/103 29/897.3 |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 | 9/2015 | Themig et al. | |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,719,322 | B2 * | 8/2017 | Goebel | E21B 43/10 |
| 9,816,351 | B2 | 11/2017 | Lirette et al. | |
| 9,885,222 | B2 * | 2/2018 | Andrigo | E21B 33/16 |
| 9,920,620 | B2 | 3/2018 | Murphree et al. | |
| 10,024,150 | B2 | 7/2018 | Andreychuk et al. | |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 10,837,269 | B2 * | 11/2020 | Feng | E21B 34/103 |
| 11,203,911 | B1 * | 12/2021 | Rogers | E21B 33/13 |
| 11,280,157 | B2 * | 3/2022 | Acosta | E21B 33/14 |
| 11,293,253 | B2 | 4/2022 | Santoso et al. | |
| 11,306,562 | B1 * | 4/2022 | Giroux | E21B 34/142 |
| 11,566,489 | B2 * | 1/2023 | Patil | E21B 23/04 |
| 2006/0207765 | A1 | 9/2006 | Hofman | |
| 2007/0261850 | A1 | 11/2007 | Giroux et al. | |
| 2008/0251253 | A1 | 10/2008 | Lumbye | |
| 2009/0071655 | A1 | 3/2009 | Fay | |
| 2009/0151960 | A1 | 6/2009 | Rogers et al. | |
| 2010/0051276 | A1 | 3/2010 | Rogers et al. | |
| 2010/0163253 | A1 | 7/2010 | Caldwell et al. | |
| 2011/0079381 | A1 * | 4/2011 | Cejero | E21B 21/103 29/897.3 |
| 2013/0048290 | A1 | 2/2013 | Howell et al. | |
| 2013/0233570 | A1 | 9/2013 | Acosta et al. | |
| 2013/0233572 | A1 | 9/2013 | Helms et al. | |
| 2014/0224479 | A1 * | 8/2014 | Andrigo | E21B 33/16 166/192 |
| 2015/0027706 | A1 | 1/2015 | Symms | |
| 2015/0184489 | A1 | 7/2015 | Resweber | |
| 2016/0010400 | A1 * | 1/2016 | Goebel | E21B 43/10 166/382 |
| 2016/0138367 | A1 | 5/2016 | Lirette et al. | |
| 2017/0145784 | A1 | 5/2017 | Zhou | |
| 2019/0017366 | A1 | 1/2019 | Alaas et al. | |
| 2019/0249549 | A1 | 8/2019 | Fripp et al. | |
| 2019/0353002 | A1 | 11/2019 | Watson et al. | |
| 2019/0383117 | A1 * | 12/2019 | Feng | E21B 43/26 |
| 2020/0270967 | A1 | 8/2020 | Fong et al. | |
| 2021/0010345 | A1 | 1/2021 | Acosta et al. | |
| 2022/0018213 | A1 * | 1/2022 | Acosta | E21B 33/14 |

OTHER PUBLICATIONS

Halliburton Brochure, "Cementing ES II Stage Cementer," Feb. 2009.

Halliburton Brochure, "Fidelis Stage Cementer," Sep. 2013.

International Search Report and Written Opinion dated Apr. 5, 2021, in PCT Application No. PCT/US2020/053694.

International Search Report and Written Opinion dated Jun. 20, 2022, in PCT Application No. PCT/US2022/020696.

Halliburton Installation and Operating Instructions, OBSIDIO 9-⅝ Multiple Stage Mechanical Packer Collar, pp. 12, 13, 17 and 18, May 2021.

International Search Report and Written Opinion dated Aug. 22, 2023, in corresponding PCT Application No. PCT/US2023/021535.

* cited by examiner

OPERATING SLEEVE

The field relates to an operating sleeve used in the oil and gas industry.

BRIEF DESCRIPTION OF THE DRAWINGS

FIG. 6 is a cross section of the multi-stage cementing tool after drill out is complete.

FIG. 9 is an exploded cross section of an additional embodiment of an operating sleeve.

FIG. 12 is an enlarged view of a thread on an operating sleeve.

FIG. 13 is a cross section showing the profile of the thread.

DESCRIPTION OF AN EMBODIMENT

Figure 1:
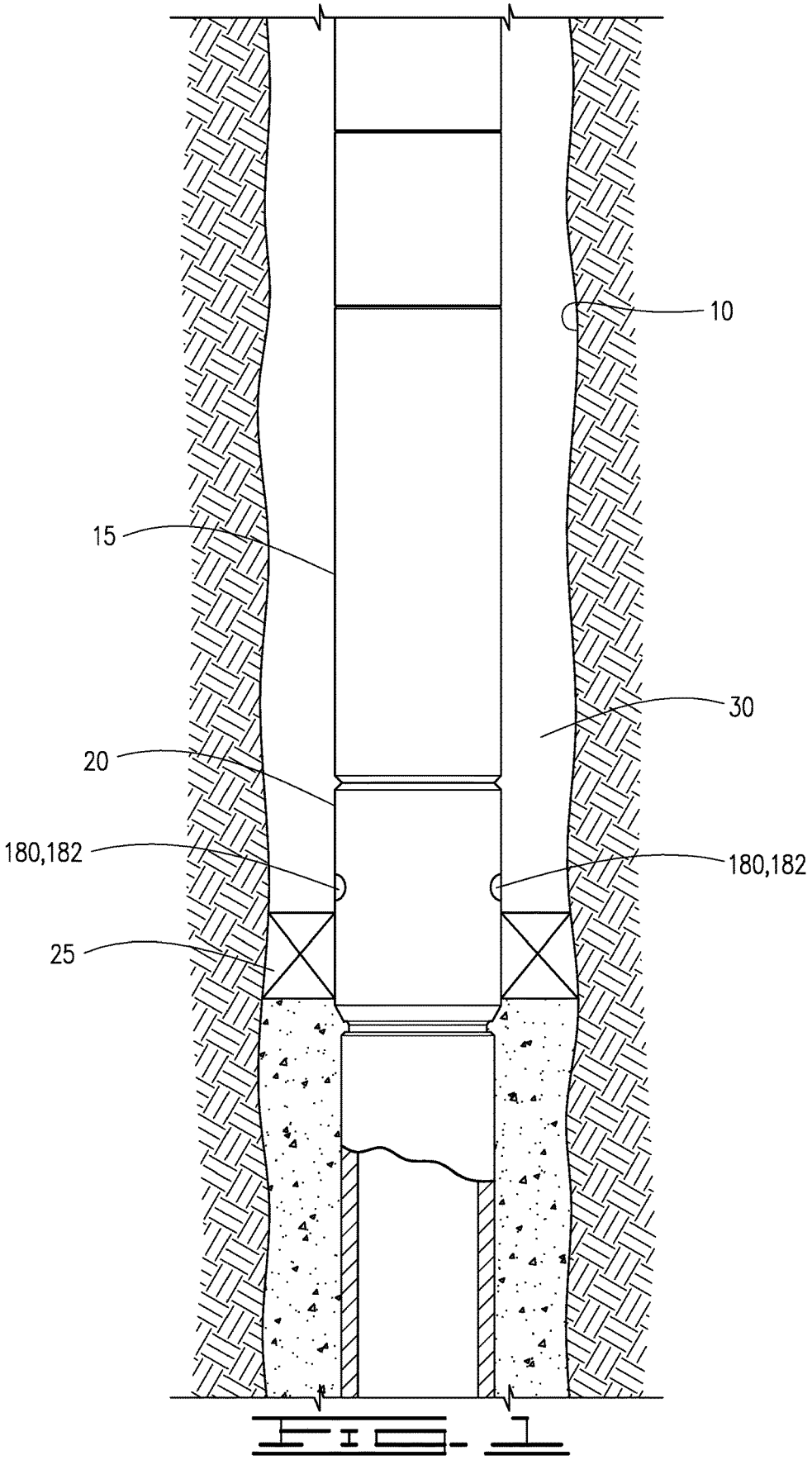
FIG. 1 is a schematic showing a casing with a multi-stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

During well completion, it is common to introduce a cement composition into an annulus in a wellbore. For example, in a cased-hole wellbore, a cement composition can be placed into and allowed to set in the annulus between the wellbore wall and the outside of the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore.

In cementing operations, a spacer fluid is typically introduced after the drilling fluid into the casing. The spacer fluid pushes the drilling fluid through the casing and up into an annular space towards a wellhead. A cement composition can then be introduced after the spacer fluid into the casing. There can be more than one stage of a cementing operation. Each stage of the cementing operation can include introducing a different cement composition that has different properties, such as density. A lead cement composition can be introduced in the first stage, while a tail cement slurry can be introduced in the second stage. Other cement compositions can be introduced in third, fourth, and so on stages.

A cement composition should remain pumpable during introduction into a wellbore. A cement composition will ultimately set after placement into the wellbore. As used herein, the term "set," with respect to a cement composition and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days.

During first stage cementing operations, a first cement composition (e.g., a lead slurry) can be pumped from the wellhead, through the casing and a downhole tool that can include a float shoe or collar, out the bottom of the casing, and into an annulus towards the wellhead. At the conclusion of the first stage, a shut-off plug can be placed into the casing, wherein the plug engages with a restriction near the bottom of the casing such as a seat and closes a fluid flow path through the casing.

In cementing operations, and other downhole operations operating sleeves are utilized for a number of reasons. For example, operating sleeves are used to open and close ports through which a cement composition or other fluid may flow from a flow passage through a tubular to an annulus outside the tubular, to set packers, and for other uses. Once the desired operation has been performed, it is often desirable to drill out the plug seats used in operating sleeves to open up the flow passage through the tubular. Operating sleeves generally consist of an operating sleeve body and a plug seat at the upper end of the operating sleeve body. During drill out operations, the plug seat will sometimes rotate relative to the operating sleeve body which can make the drill out process time consuming and costly.

FIG. 1 shows apparatus 20, which in one embodiment is a stage cementing tool 20 lowered into a wellbore 10 on casing 15. A compression packer 25 on stage cementing tool 20 is designed to support a hydrostatic column of cement and uses only one plug to set the stage cementing tool 20 in the wellbore 10. A minimum amount of drill out is needed after the use of the stage cementing tool 20 is complete as described herein.

An annulus 30 is defined by and between stage cementing tool 20 and wellbore 10. Although depicted in an uncased wellbore 10, it is understood that use of the stage cementing tool is not so limited, and may be used in a cased wellbore. Likewise, although the schematic in FIG. 1 shows use in a vertical wellbore, it is understood that apparatus 20 can be used in deviated and horizontal wellbores. Stage cementing tool 20 comprises a tool body 32 with upper end 34 and lower end 36. Stage cementing tool 20 is shown in a first, or run-in position 38 in FIG. 2. Stage cementing tool 20 is shown in a second, or set position 40 in FIG. 3 and in a third, or cementing position 42 in FIG. 4. A fourth position of stage cementing tool 20 is shown in FIG. 5, and is a closed, or completed position 43. An adapter 44 may be connected at upper end 34 of tool body 32 to connect in casing string 15. Stage cementing tool 20 defines a central flow passage 46 therethrough. Tool body 32 has inner surface 48 and exterior, or outer surface 50.

A first operating sleeve 52 is slidably disposed in tool body 32. First operating sleeve 52 comprises first operating sleeve body 54 and a first plug seat 56 anchored thereto. First plug seat 56 is positioned at an upper end 58 of first operating sleeve body 54. First operating sleeve body 54 has lower end 60, outer surface 62 and inner surface 64. First operating sleeve body 54 defines a first inner diameter 66 and a second inner diameter 68 on the inner surface 64 thereof. Inner diameter 66 is greater than inner diameter 68, and a tapered shoulder 70 extends radially inwardly from inner diameter 66 to inner diameter 68 of inner surface 64. Shoulder 70 defines an angle 71 with inner surface 64 at diameter 66, which in one embodiment may be in the range of about 30° to 60°, and may for example be about 45°.

Inner surface 64 has an internal thread 72 defined thereon that extends inwardly from inner diameter 66. Thread 72 has, first and second faces, or flanks, 74 and 76. First face is a generally square face, such that square face 74 and inner surface 64 define an angle 78 therebetween. Angle 78 may be in the range of about 80° to 110° and may be for example about Second face 76 is a slanted face, such that slanted face 76 and inner surface 64 define an angle 80 therebetween. Angle 80 may be in the range of about 105° to 135° and may be for example about 120°.

Thread 72 has an internal, or minor diameter 82 and has a sharp point at its crest 84. Thread 72 thus extends radially inwardly from diameter 66 a distance 85 that defines a height 86 of thread 72. Thread 72 has a wide pitch that in one embodiment may be for example three to four inches.

First plug seat 56 has outer surface 100 that is a generally cylindrical outer surface 100. Outer surface 100 is in one embodiment a smooth, unthreaded outer surface. First plug seat 56 has upper and lower ends 102 and 104 respectively. First plug seat 56 has a first plug seat outer diameter 106 and a first plug seat inner diameter 108. An engagement seat 110 is defined at upper end 102 of first plug seat 56. First plug seat 56 is anchored in first operating sleeve body 54 by thread 72. The engagement of thread 72 with first plug seat 56 will fix first plug seat 56 to first operating sleeve body 54. Internal diameter 82 may thus be referred to as an anchor diameter, since the engagement of thread 72 with first plug seat 56 anchors first plug seat 56 therein when inserted into first operating sleeve body 56. Likewise, thread 72 may be referred to as a plug seat anchor. Outer diameter 106 is greater that internal thread diameter 82 so there is an interference fit between first operating sleeve body 54 and first plug seat 56, and specifically between thread 72 and first plug seat 56.

First plug seat 56 may be inserted into first operating sleeve body 54 by simply pressing the first plug seat 56 into first operating sleeve body 54 through the opening at upper end 58 thereof. First plug seat 56 and first operating sleeve body 54 may be made from dissimilar materials. First plug seat 56 will be made from a material that is softer than first operating sleeve body 54, so that it will elastically deform as it is pressed into first operating sleeve body 54. Once first plug seat 56 is fully inserted, the material from which it is made will relax, and the thread 72 will bite into, or cut into the outer surface 100 thereof.

First plug seat 56 may be made, for example, from a phenolic with fabric fiber reinforcing material molded therein. Other materials may be used for the first plug seat 56. For example, another material that could be used for the first plug seat 56 is a fiber wound composite material. Other molded or injection molded materials may also be used with a variety of different reinforcing media to support the base material. The reinforcing media can be for example fiberglass or carbon fiber introduced for strength and or toughness. The material for plug seat 56 will in any case typically be softer and more malleable than the sleeve material in which it is inserted. The material for first operating sleeve body 54 will normally be a hardened steel of similar strength to the casing string in which the stage cementing tool is used. The individual features of first operating sleeve 52, which may also be referred to as an opening sleeve, and the features of the first operating sleeve body 54 and first plug seat 56 components are better seen in FIGS. 8-13.

Figure 2:
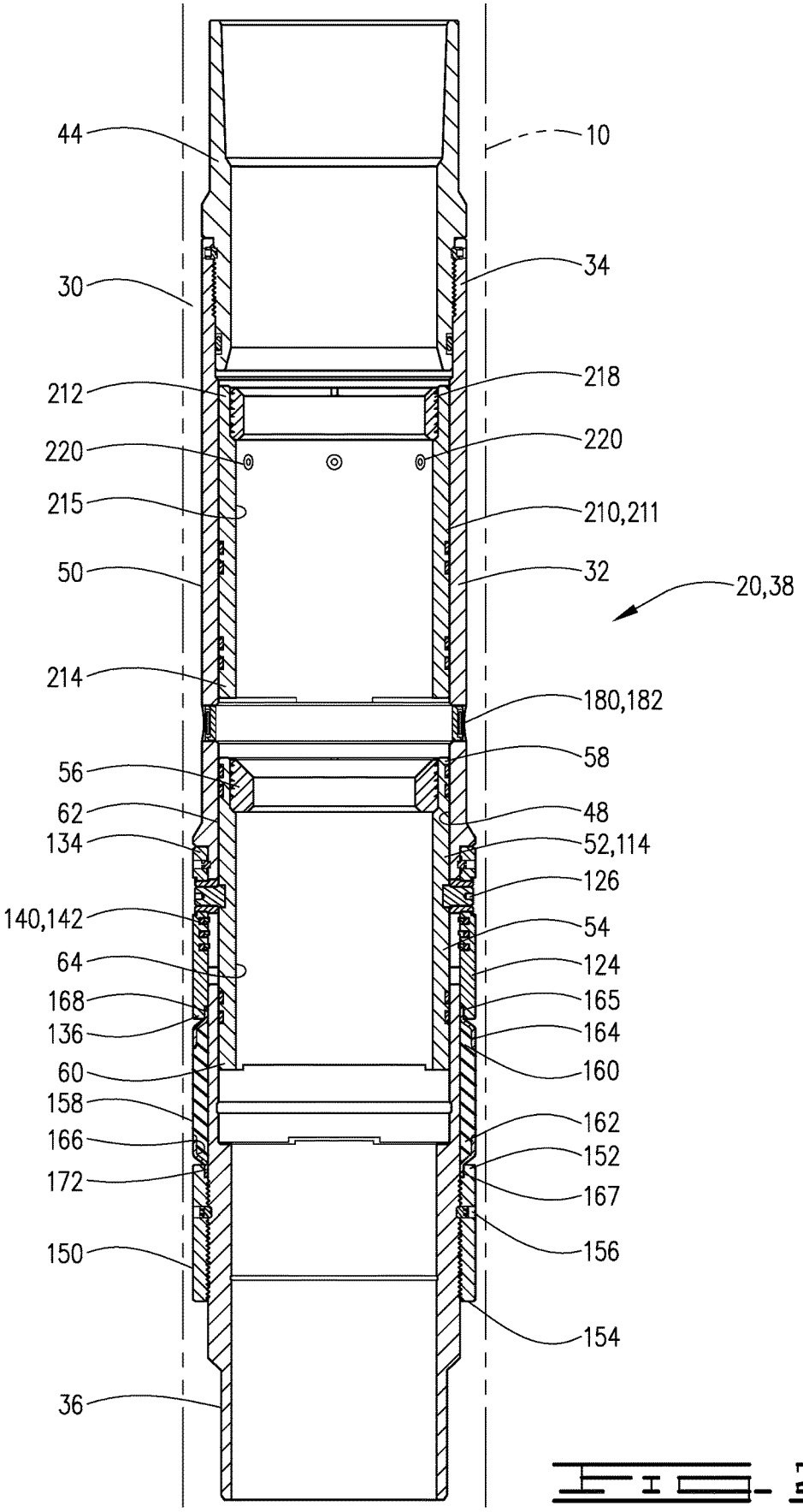
FIG. 2 is a cross section of a multi-stage cementing tool with an operating sleeve as disclosed herein in a run-in position.
Figure 3:
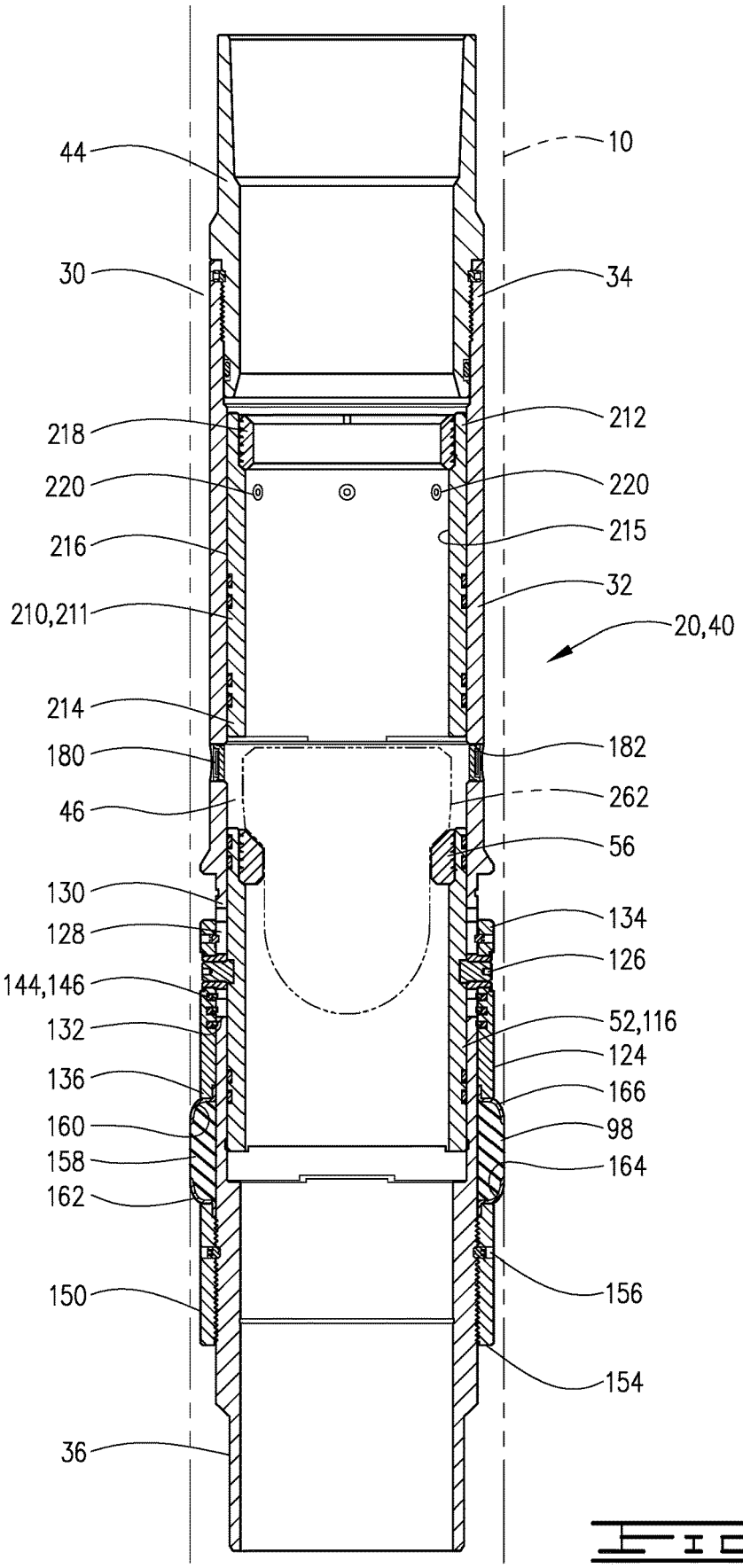
FIG. 3 is a cross section of the multi-stage cementing tool after it has been moved to a set position.
Figure 4:
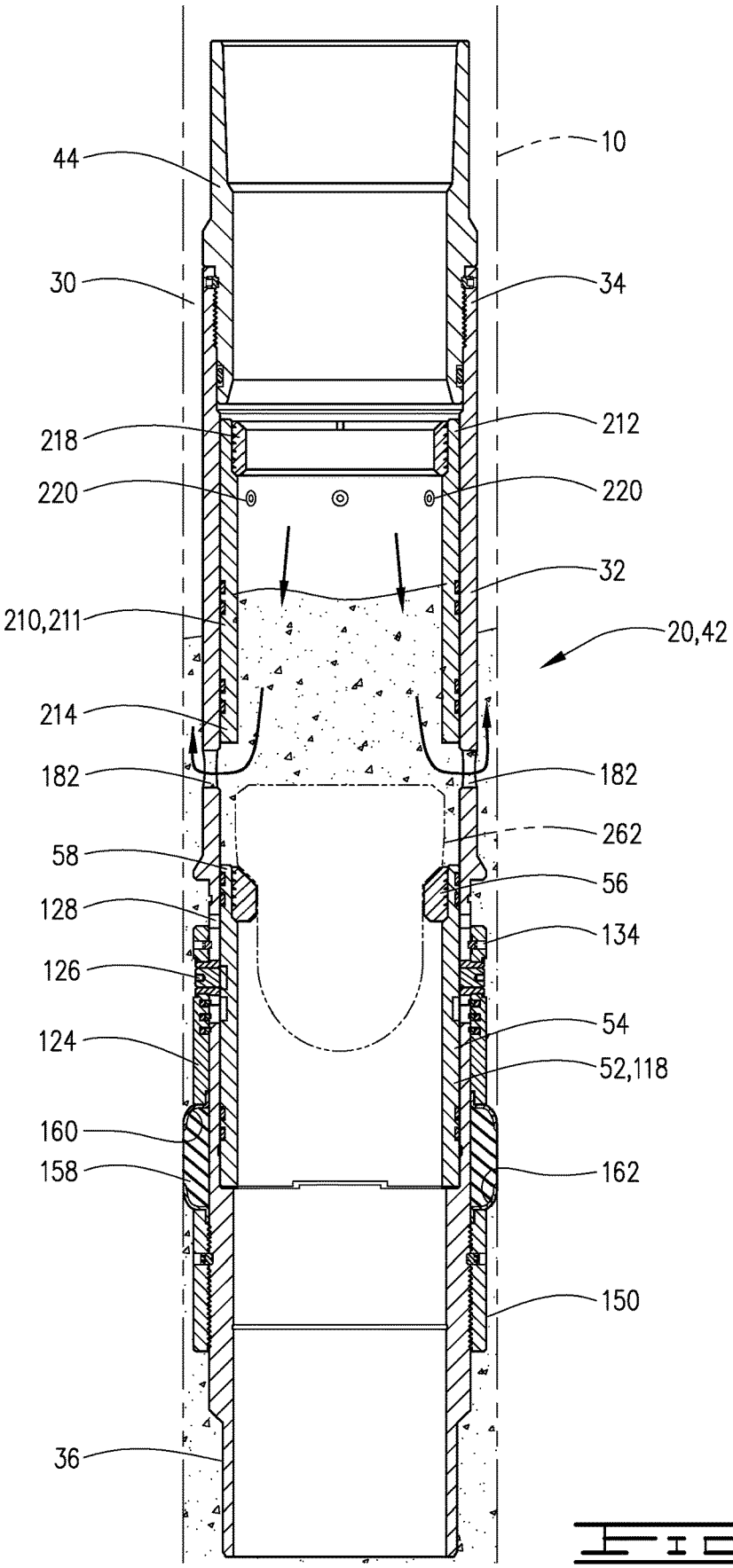
FIG. 4 is a cross section of the multi-stage cementing tool after it has been moved to a cementing position.
Figure 5:
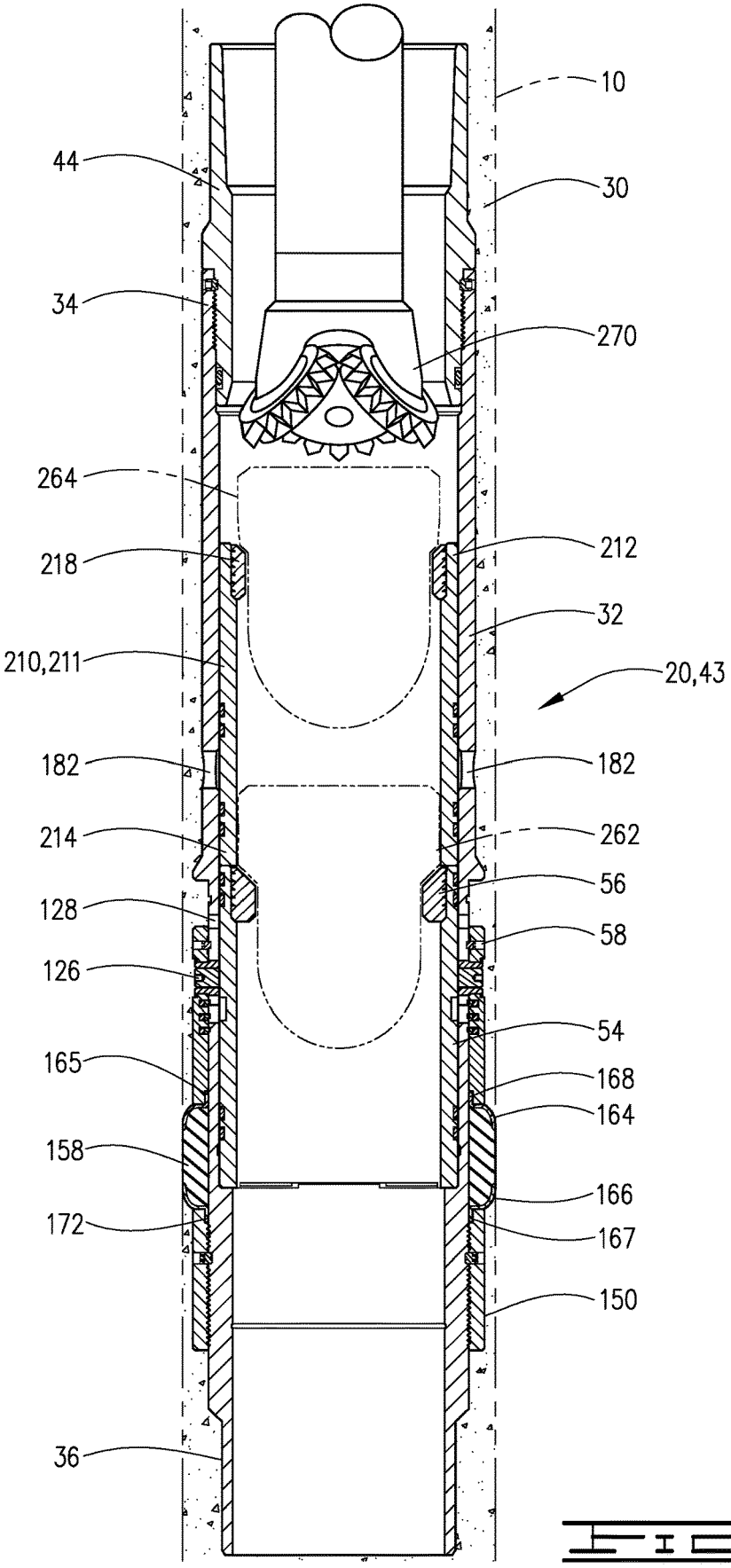
FIG. 5 is a cross section of the multi-stage cementing tool after it has been moved to a finished position.
Figure 5:
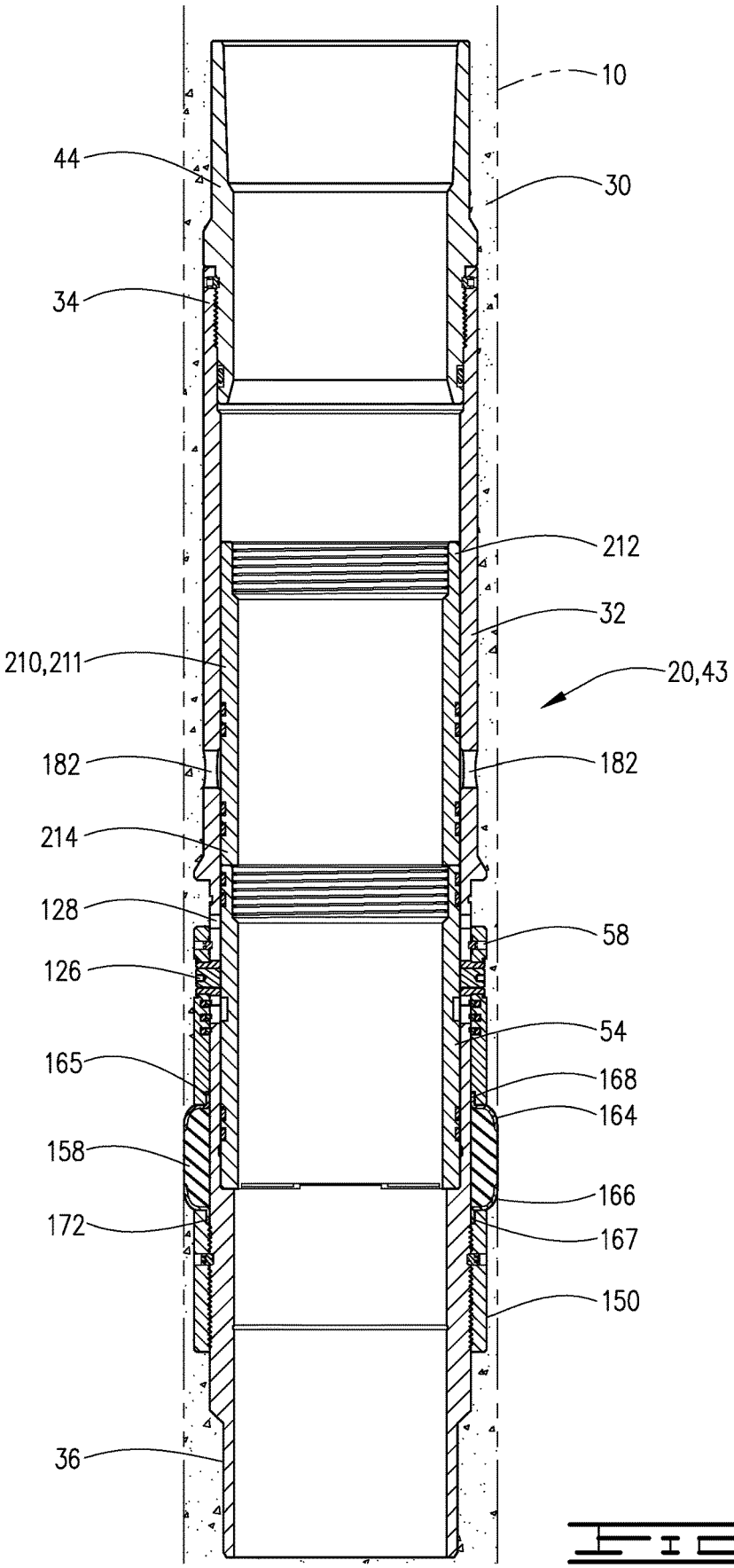
Figure 7:
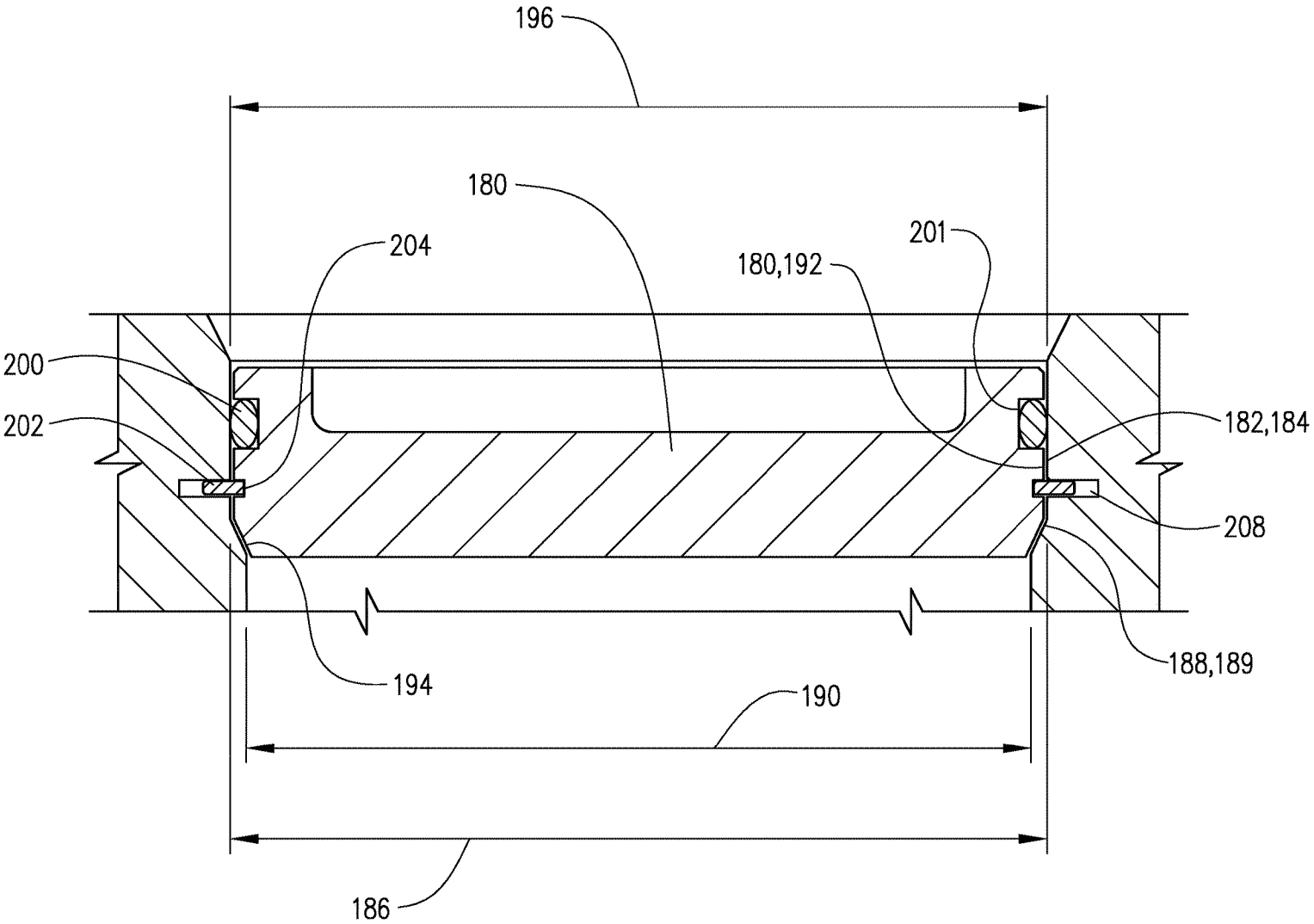
FIG. 7 is a cross section of an exemplary pump-out plug used with a multi-stage cementing tool.

First operating sleeve 52 is shown in a first position 114 in FIG. 2, which corresponds to the run-in position 38 of the stage cementing tool 20, a second position 116 in FIG. 3 which corresponds to the set position 40, and a third position 118 in FIG. 4, which corresponds to the cementing position 42 of stage cementing tool 20. First operating sleeve 52 stays in its third position 118 when stage cementing tool 20 is in the closed position 43.

A setting sleeve 124 is disposed about tool body 32 and is slidable thereon. Setting sleeve 124 is connected to first operating sleeve 52 with frangible connectors, which may be for example shearable drive pins 126. Slots 128 with upper end 130 and lower end 132 are defined in tool body 32. Setting sleeve 124 has upper end 134 and lower end 136. Lower end 136 is a flat, or snub-nosed end 136, which may be described as a flat annular face. Shearable drive pins 126 extend through slots 128 and are movable therein.

A plurality of locking elements 140 are disposed in grooves 142 in setting sleeve 124. Locking elements in one embodiment may comprise lock rings 144 and a biasing element 146, which may comprise a wave spring that biases a lock ring 144 toward tool body 32.

A packer stop 150 is attached to tool body 32 and may be threaded thereto. Packer stop 150 has upper end 152 and lower end 154. Upper end 152 is a flat, snub nosed stop 152, which may be described as a flat annular face. Lock screws 156 may also be used to hold packer stop 150 in place. A packer element 158 is disposed about tool body 32 and has upper and lower ends 160 and 162 respectively.

An upper anti-extrusion element 164 covers upper end 160 of packer element 158 and has an upwardly extending leg 165. Leg 165 encircles tool body 32 above packer element 158. A lower anti-extrusion element 166 covers lower end 162 of packer element 158 and has a downwardly extending leg 167. Leg 167 encircles tool body 32 below packer element 158. An annular space 168 is defined by and between setting sleeve 124 and tool body 32 at the lower end 136 of setting sleeve 124. Leg 165 is positioned in space 168, and is captured between tool body 32 and setting sleeve 124 at lower end 136 thereof. An annular space 172 is defined by and between packer stop 150 at the upper end 152 of packer stop 150. Leg 167 is positioned in space 172, and is captured between tool body 32 and packer stop 150 at upper end 152 thereof.

Pump-out plugs 180 are positioned in ports 182 in a wall 22 of stage cementing tool and in the described embodiment in tool body 32. Apparatus 20 will have at least one pump-out plug 180, and in the embodiment shown includes a plurality of pump out plugs 180. As many as four pump-out plugs may be used although two are normally sufficient to provide redundancy. Central flow passage 46 is communicated with annulus 30 through port 182 when pump out-plug 180 is expelled into annulus 30. Port 182 in one embodiment has a first, cylindrical portion 184 that defines an inner diameter 186. A second portion 188 of port 182 tapers inwardly from first portion 184 and defines an inner diameter 190 that is smaller than diameter 186. Pump out plug 180 is sealingly received in port 182. Second portion 188 defines a sloped shoulder 189 against which pump-out plug 180 will abut, to prevent pressure in annulus 30 from pushing plug 180 into central flow passage 46.

Pump-out plug 180 comprises a first generally cylindrical portion 192 received in cylindrical portion 184 of port 182, and a second tapered portion 194 that is tapered inwardly from first portion 192. First portion 192 has an outer diameter 196, and may be referred to as a plug body. Second portion 194 may be referred to as a plug head. Plug head 194 will engage sloped shoulder 189 as described above. A seal 200, which may be an O-ring seal, is received in a groove 201 and sealingly engages port 182. Plug 180 may be retained in port 182 by a frangible retainer, which may be for example a retaining ring, shear pin or other frangible retainer. In the embodiment of FIG. 5, a retaining ring 202 is received in groove 204 in tool body 32 and groove 208 in pump-out plug 180. Retaining ring 202 detachably connects plug 180 to tool body 32 and will prevent the pump-out plug 180 from being expelled into annulus 30 prematurely. Retaining ring 202 will also aid in preventing the plug 180 from being pushed into central flow passage 46 due to pressure in the annulus 30. The engagement of plug head 194 with sloped shoulder 189 of port 182 will in any event prevent plug 180 from being pushed into central flow passage 46 as a result of pressure in the annulus 30. Other configurations for pump out plug 180 and port 182 are possible, and the configuration described here is but one embodiment.

A second operating sleeve 210 comprises a second operating sleeve body 211 with a second plug seat 218 anchored thereto at an upper end 212 thereof. Second operating sleeve body 211 has a lower end 214, inner surface 215 and outer surface 216. Second operating sleeve 210 is sealingly received in tool body 32. Second operating sleeve 210 is detachably connected in tool body 32 with frangible pins 220. Pins 220 may be shear pins configured to break at a predetermined pressure. Flow ports 182 with pump-out plugs 180 therein are positioned between lower end 214 of second operating sleeve 210 and upper end 58 of first operating sleeve 54 in the run-in position of apparatus 20.

Second operating sleeve body 211 defines a first inner diameter 226 and a second inner diameter 228 on the inner surface 215 thereof. Inner diameter 226 is greater than inner diameter 228, and a tapered shoulder 230 extends radially inwardly from inner diameter 226 to inner diameter 228 of inner surface 215. Shoulder 230 defines an angle 231 with inner surface 215 on diameter 226, which in one embodiment may be in the range of about 30° to 60°, and may for example be about 45°.

Inner surface 215 has an internal thread 232 defined thereon that extends inwardly from inner diameter 226. Thread 232 has first and second faces, or flanks, 234 and 236. The thread features of both threads 72 and 232 on first and second operating sleeve bodies 54 and 211 are shown on FIG. 12. First face 234 is a generally square face, such that square face 234 and inner surface 64 define an angle 238 therebetween. Angle 238 may be in the range of about 80° to 110° and may be for example about 90°. Second face 236 is a slanted face, such that slanted face 236 and inner surface 64 define an angle 80 therebetween. Angle 240 may be in the range of about 105° to 135° and may be for example about 120°.

Thread 232 has an internal, or minor diameter 242 and has a sharp point at its crest 244. Thread 232 thus extends radially inwardly from diameter 226 a distance 245 that defines a height 246 of thread 232. Thread 232 has a wide pitch that in one embodiment may be for example three to four inches.

Second plug seat 218 has outer surface 250 that is a generally cylindrical outer surface 250. Outer surface 250 is in one embodiment a smooth, unthreaded outer surface. Second plug seat 218 has upper and lower ends 252 and 254 respectively. Second plug seat 218 has an outer diameter 256 and an inner diameter 258. An engagement seat 260 is defined at upper end 252 of second plug seat 218. Second plug seat 218 is anchored in second operating sleeve body 211 by thread 232. The engagement of thread 232 with second plug seat 218 will fix second plug seat 218 to second operating sleeve body 211. Outer diameter 256 is greater than internal thread diameter 242 so there is an interference fit between first operating sleeve body 54 and second plug seat 218, and specifically between thread 232 and second plug seat 218. Internal thread diameter 242 may thus be referred to as an anchor diameter, since the engagement of thread 232 with second plug seat 218 anchors second plug seat 218 therein when inserted into second operating sleeve body 211. Thread 232 may be referred to as a plug seat anchor.

Second plug seat 218 may be inserted into second operating sleeve body 211 by simply pressing the second plug seat 218 into second operating sleeve body 211 through the opening at upper end 212 thereof. Second plug seat 218 and second operating sleeve body 211 may be made from dissimilar materials. Second plug seat 218 will be made from a material that is softer than second operating sleeve body 211, so that it will elastically deform as it is pressed into second operating sleeve body 211 Once second plug seat 218 is fully inserted, the material from which it is made will relax, and the thread 232 will bite into, or cut into the outer surface 216 thereof. The material for second plug seat 218 and second operating sleeve body 211 are as described with respect to first plug seat 56 and first operating sleeve body 54. FIG. 12 includes identifying numbers for common features of the threads 72 and 232 on first and second operating sleeves 52 and 210. The individual features of second operating sleeve 210, which may also be referred to as a closing sleeve, and the features of the second operating sleeve body 211 and second plug seat 218 components are better seen in FIGS. 9 and 13.

Figure 8:
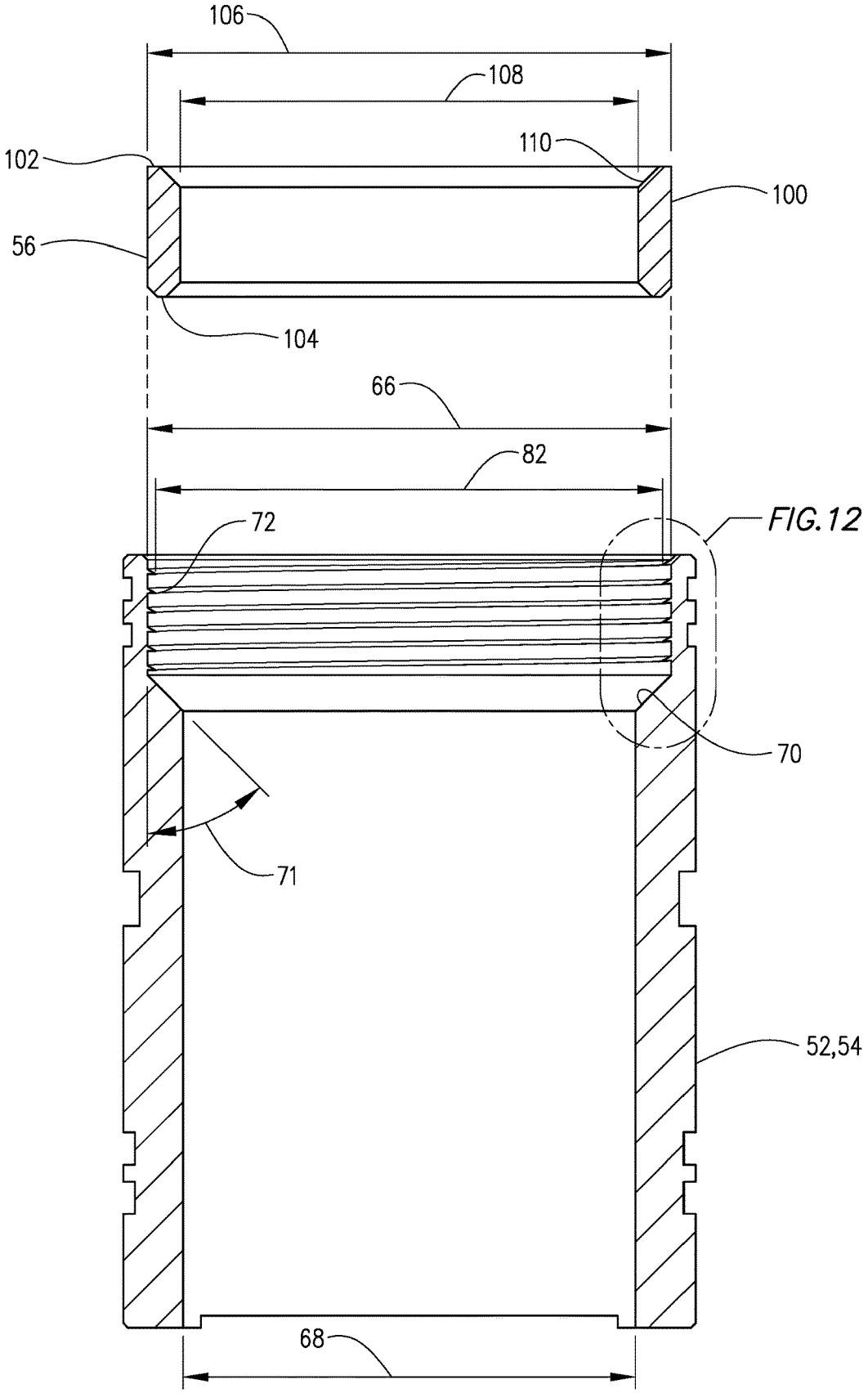
FIG. 8 is an exploded cross section of an operating sleeve.
Figure 3:
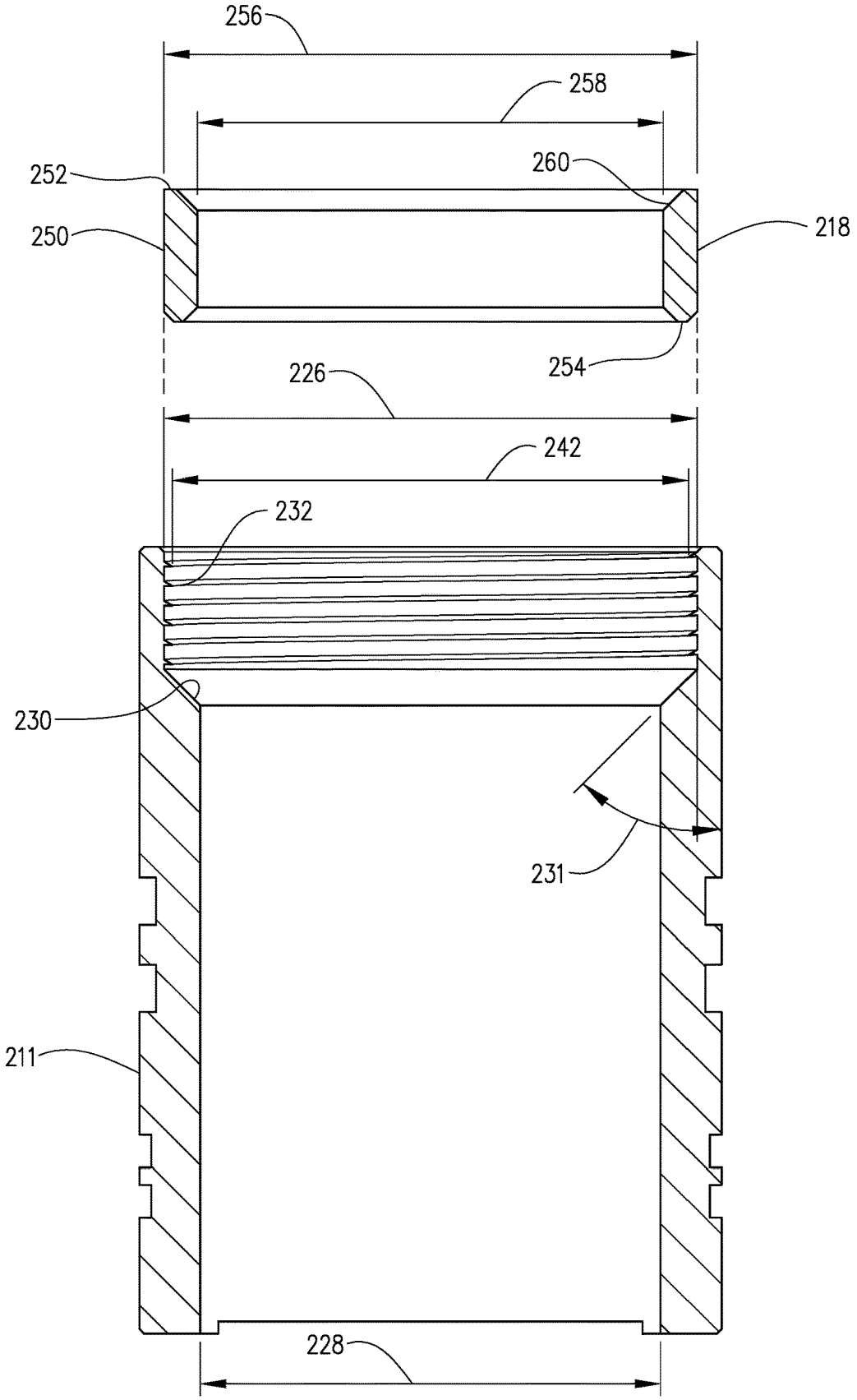
Figure 10:
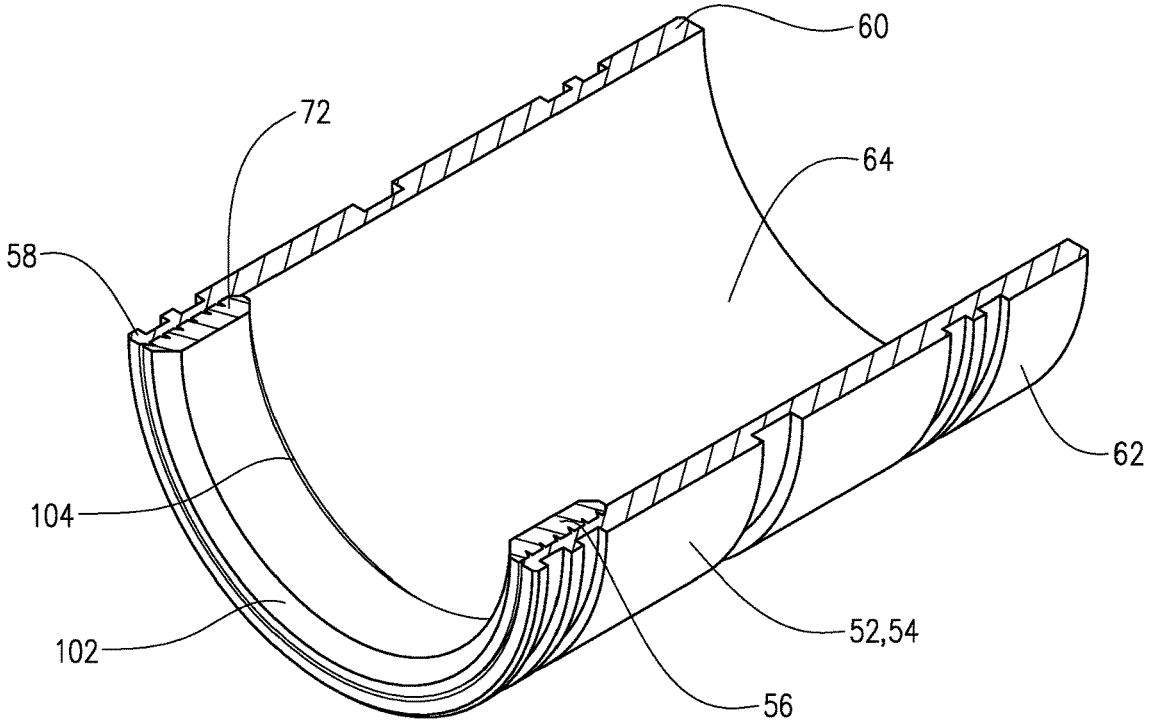
FIG. 10 is a perspective cross section of the operating sleeve of FIG. 8.
Figure 11:
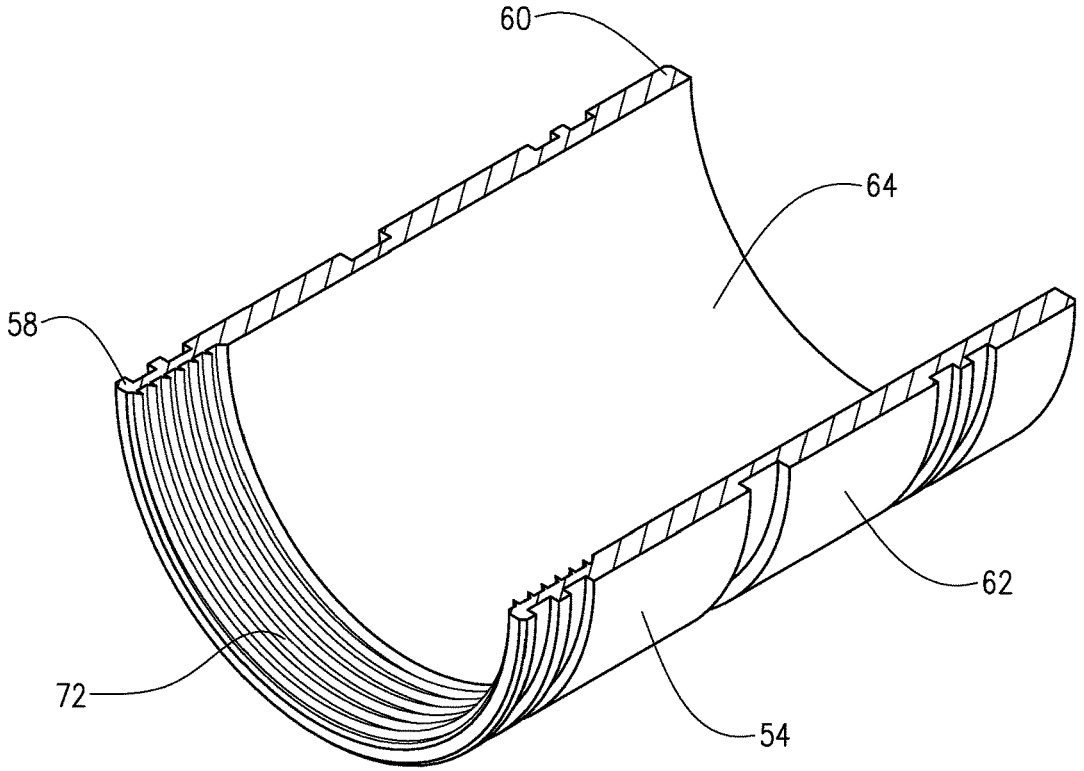
FIG. 11 is a perspective cross section of the operating sleeve body of FIG. 8.
Figure 19:
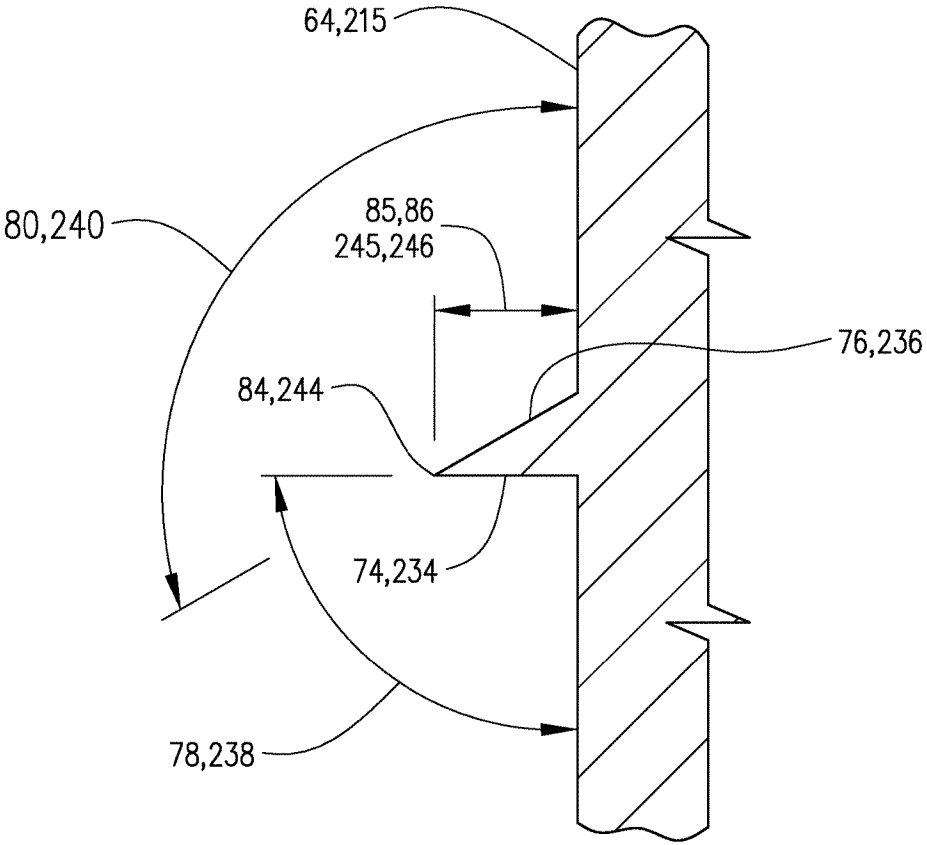
Figure 17:
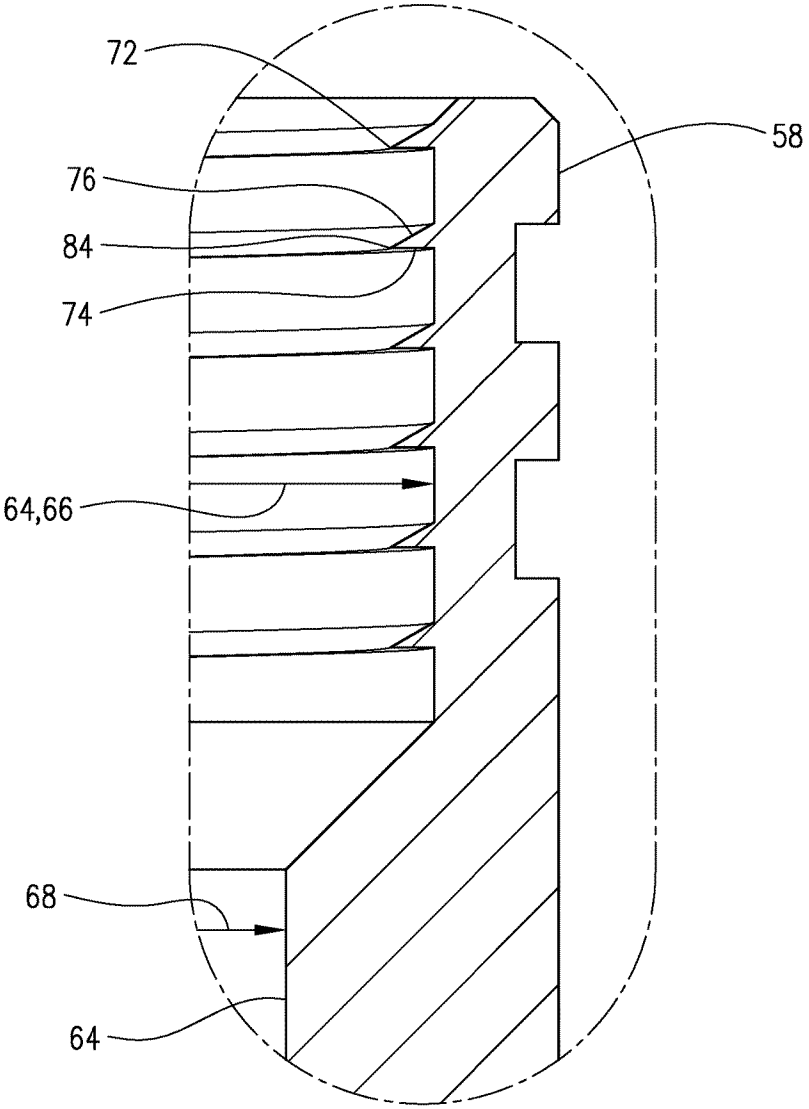

FIG. 8 and FIG. 9 are exploded views of the first and second operating sleeves 52 and 210. When inserted first plug seat 56 is fixed to first operating sleeve body 54 as a result of the engagement of thread 72 with first plug seat 56. Thread 72 will bite into the outer surface 100 of first plug seat 56 and will extend through the outer surface 100 into first plug seat 56. The assembled second operating sleeve 210, with second operating sleeve body 211 and second plug seat 218 are assembled in the same manner.

The dimensions of first and second operating sleeves 52 and 210 will be driven in most cases by the environment downhole and the operation being conducted. As is apparent from the drawings, inner diameter 258 of second plug seat 218 will be larger than inner diameter 108 of first plug seat 56. As an example, in one embodiment for use in a stage cementing tool as described, the outer diameters 106 and 256 of the first and second plug seats 56 and 218 respectively may be in the range of 8.79-8.83 inches and the inner diameters 66 and 226 of the first and second operating sleeve bodies 54 and 211 respectively may be about 8.86-8.90 inches. Threads 72 and 232 may have heights 85 and 245 of 0.03-0.09 inches, and will in every case have a height sufficient to bite into the outer surface of the plug seats 56 and 218. The inner diameters 108 and 258 of first and second plug seats 56 and 218 may be for example about 6.20-6.30 inches and 7.45-7.55 inches respectively. The outer diameters 106 and 256 of first and second plug seats 56 and 218 may be the same as described here or may be different. Likewise, the inner diameters 66 and 226 of first and second operating sleeve bodies 54 and 211 may be the same as each other, but may also be different. The dimensions given here are non-limiting and provided only as examples.

In operation, the apparatus 20 is lowered into a wellbore on casing string 15. In a first stage, or the stage prior to the stage to be completed through flow ports 182, a cement composition may be pumped though casing 15 and into annulus 30 through a lower end of casing 15, or through additional ports in the casing below ports 182. At the conclusion of the first, or prior stage, a shutoff plug may be pumped into the casing 15. The schematic in FIG. 1 shows cement in annulus below stage cementing tool 20. As previously noted, stage cementing tool 20 is shown in a vertical wellbore, but may be used in deviated or horizontal wellbores as well.

Apparatus 20 may be moved to the set position of the apparatus 20 in which packer element 158 is expanded radially outwardly to engage wellbore 10, which in the embodiment described is an uncased wellbore, but which may also be a cased wellbore. Packer element 158 is moved outwardly solely by placing the packer element 158 in compression, as opposed to using inflation, or the use of wedges and ramps which are commonly used to expand packer elements in other packer tools. Apparatus 20 is moved to the set position with the use of a first plug 262, which in the described embodiment is a setting plug 262. Setting plug 262 is passed into casing and will be moved downwardly therein. Setting plug 262 will pass though second plug seat 218 and will engage first plug seat 56.

Once setting plug 262 engages first plug seat 56, pressure is increased to move first operating sleeve 52 downwardly in tool body 32. Setting sleeve 124 will move downwardly with first operating sleeve 52 since setting sleeve 124 and first operating sleeve 52 are connected with frangible drive pins 126. Pressure is continuously applied so that setting sleeve 124 is pushed into packer element 158.

Compression is applied to packer element 158 by the annular flat face at the lower end 136 of setting sleeve 124 to the upper end 160 of packer element 158. Packer stop 150 is fixed to tool body 32 and is stationary. Packer element 158 is prevented from moving downward by the annular flat upper face at the upper end 152 of packer stop 150. Compression is applied to packer 158 until it expands radially outwardly sufficiently to move to the set position 40 in which packer element 158 engages and seals against wellbore 10. Locking elements 140 are biased toward tool body 32, and will be urged into grooves in the tool body 32 to hold setting sleeve 124 in place in its set position.

Pressure is applied in casing 15 until a sufficient pressure, which may be a predetermined pressure, is reached to apply a force to the drive pins 126 that is sufficient to break the frangible drive pins 126. Once drive pins 126 are broken, first operating sleeve 52 will move downwardly in tool body 32 to the position shown in FIG. 4. Setting sleeve 124 is fixed to tool body 32 with locking elements 140 such that it maintains compression on packer element 158 to keep the apparatus 20 in its set position. No ramps or wedges are used to expand packer element 158, and the radial expansion of packer element 158 is caused solely by the compression applied by setting sleeve 124.

Upper anti-extrusion element 164 captures upper end 160 of packer element 158 so that packer element 158 does not extrude around setting sleeve 124, and does not intrude into any gaps that may exist between setting sleeve 124 and tool body 32. Leg 165 of anti-extrusion element 164 occupies the space defined between setting sleeve 124 and tool body 32 to prevent the packer element 158 from intruding, or squeezing into that space. Lower anti-extrusion element 166 captures lower end 162 of packer element 158 so that packer element 158 does not extrude around packer stop 150, and does not intrude into any gaps that may exist between packer stop 150 and tool body 32. Leg 167 of anti-extrusion element 166 occupies the space defined between packer stop 150 and tool body 32 to prevent the packer element 158 from intruding, or squeezing into that space.

Once first operating sleeve 52 is moved to the position shown in FIG. 4, apparatus 20 is in the cementing position 42 and pressure may be increased to a pressure, which may be a predetermined pressure, that will generate a sufficient force applied to plugs 180 to break retaining rings 202. Pump-out plugs 180 will then be expelled into annulus 30, and a cement composition or other fluid may be delivered into annulus 30 through ports 182. Once the delivery of the cement composition, or other fluid is complete, second operating sleeve 210 can be moved from its first position shown in FIG. 2 to a second position shown in FIG. 5 in which second operating sleeve 210 prevents flow between annulus 30 and central flow passage 46 through flow ports 182.

Second operating sleeve 210 is moved to its second position with a second, or closing plug 264 that is dropped through casing 15. Closing plug 264 will engage closing seat 218, and pressure thereabove is increased until a sufficient force is applied to frangible pins 220 to break the pins 220 and detach second operating sleeve 210 from tool body 32 so that it may move downwardly to the position shown in FIG. 5, which is the completed position of apparatus 20.

Once second operating sleeve 210 is moved to the completed position shown in FIG. which may be referred to as a closed position of the tool 20, first and second plugs 262 and 264, along with first and second plug seats 56 and 218 may drilled out so that production, or other operations may be performed in casing 15. FIG. 5 shows a drill bit 270 engaging second plug seat 264. Adapter 44 will have a diameter that allows drill bit 270 to pass therethrough to engage first and second plugs 262 and 264 and first and second plug seats 56 and 218.

Drill bit 270 will engage second plug 264 and will drill therethrough until second plug seat 218 is reached. Because plug seat 218 is anchored to second operating sleeve body 211 with thread 232, rotation of second plug seat is prevented, or at least lessened from the rotation that occurs with a non-anchored plug seat. If second plug seat 218 begins to try to rotate as a result of drill bit rotation, the thread 232 is shaped so that the rotation will urge the plug seat 218 downwardly into shoulder 230 to tighten the second plug seat 218 in the second operating sleeve body 211 and prevent rotation of the second plug seat 218.

Once the drill bit 270 passes through second plug seat 218, it will engage and drill through first plug 262 and first plug seat 56. Because first plug seat 56 is anchored to first operating sleeve body 54 with thread 72, rotation of first plug seat 56 is prevented, or at least lessened from the rotation that occurs with a non-anchored plug seat. If first plug seat 56 begins to try to rotate as a result of drill bit rotation, the thread 72 is shaped so that the rotation will urge the plug seat 56 downwardly into shoulder 70 to tighten the second plug seat 56 in the first operating sleeve body 54 and prevent rotation of the first plug seat 56. FIG. 6 shows the tool 20 after drill out is complete.

Embodiments include:

Embodiment 1. A downhole apparatus comprising a sleeve body, the sleeve body defining a sleeve body inner surface; an internal thread on a threaded portion of the sleeve body inner surface, the internal thread defining having a thread minor diameter; and a plug seat pressed into the threaded portion of the sleeve body, the plug seat having an unthreaded outer surface defining a plug seat outer diameter, the plug seat outer diameter being greater than the thread minor diameter.

Embodiment 2. The downhole apparatus of embodiment 1 the thread defining a sharp point at the crest thereof.

Embodiment 3. The downhole apparatus of either of embodiments 1 and 2, wherein the thread grippingly engages the plug seat.

Embodiment 4. The downhole apparatus of any of embodiments 1-3, the sleeve body comprising an inner surface defining first and second diameters and a tapered shoulder extending radially inwardly from the first to the second inner diameter, wherein rotation of the plug seat after it is pressed into the operating sleeve body urges the plug seat in a direction toward the tapered shoulder.

Embodiment 5. The downhole apparatus of any of embodiments 1-4, the thread having first and second flanks, one of the first and second flanks defining an angle with the sleeve body inner surface of between about 80° and 110°, the thread having a sharp point at the crest thereof.

Embodiment 6. The downhole apparatus of any of embodiments 1-5, the sleeve body and plug seat being made from dissimilar materials.

Embodiment 7. The stage cementing tool of any of embodiments 1-6, the plug seat made from a material having greater ductility than the sleeve body.

Embodiment 8. A downhole tool comprising a tool body; an operating sleeve detachably connected and movable in the tool body; the operating sleeve comprising an operating sleeve body having an upper end and a lower end; and a plug seat anchor defined on an inner surface of the sleeve body, the plug seat anchor defining an anchor diameter. A plug seat is inserted into the operating sleeve body, and the plug seat has an outer diameter that is greater than the anchor diameter so that the anchor grips the plug seat to reduce rotation between the operating sleeve body and the plug seat when the plug seat sleeve is drilled out of the operating sleeve body.

Embodiment 9. The downhole tool of embodiment 8 the anchor comprising a helical thread on the inner surface of the operating sleeve body, the anchor diameter comprising the minor diameter of the helical thread, the helical thread gripping the outer surface of the plug seat.

Embodiment 10. The downhole tool of either of embodiments 8 and 9 the sleeve body defining a first cylindrical portion with a first inner diameter and a second cylindrical portion with a second inner diameter and defining a shoulder that tapers radially inwardly from the first to the second cylindrical portions, wherein rotational force applied by a drill bit during drill out of the plug seat urges the plug seat into the tapered shoulder.

Embodiment 11. The downhole tool of any of embodiments 8-10 the plug seat made from a material having more ductility than the sleeve body.

Embodiment 12. The downhole tool of any of embodiments 9-11 the thread form of the helical thread comprising a V-shaped thread with a sharp crest.

Embodiment 13. The downhole tool of embodiment 12, the lead angle of the V-shaped thread is in the range of about 105° to 135°.

Embodiment 14. The downhole tool of any of embodiments 9-13, wherein the helical thread bites into the outer surface of the plug seat.

Embodiment 15. A downhole tool comprising a tool body and a first operating sleeve disposed in and movable relative to the tool body. The first operating sleeve comprises a first operating sleeve body, the first operating sleeve body having a helical thread on an inner surface thereof, the helical thread defining a first helical thread inner diameter. A first plug seat defining a generally cylindrical threadless outer surface with a first plug seat outer diameter is pressed into the first operating sleeve body in an interference fit with the helical thread on the first operating sleeve body, the helical thread on the first operating sleeve body thread cutting into the first plug seat when the first plug seat is in a fully inserted position.

Embodiment 16. The downhole tool of embodiment 15 further comprising a setting sleeve disposed about the tool body connected to the first operating sleeve with a plurality of shearable drive pins, the setting sleeve being movable downwardly with the first operating sleeve.

Embodiment 17. The downhole tool of either of embodiments 14 or 15 further comprising a second operating sleeve detachably connected in the tool body, the second operating sleeve comprising a second operating sleeve body, the second operating sleeve body having a helical thread on an inner surface thereof, the helical thread defining a second helical thread inner diameter and a second plug seat defining a generally cylindrical threadless outer surface with a second plug outer diameter, the second plug seat pressed into the second operating sleeve body in an interference fit with the helical thread on the second operating sleeve body, the helical thread on the second operating sleeve body cutting into the second plug seat when the second plug seat is in a fully inserted position.

Embodiment 18. The downhole tool of embodiment 17, the first and second plug seats comprised of drillable materials, wherein the engagement of the first and second helical threads with the first and second plug seats respectively helps to prevent relative rotation between the first and second plug seats and the first and second sleeve bodies during drillout of the first and second plug seats.

Embodiment 19. The downhole tool any of embodiments 15-18, the first operating sleeve body comprising an inner surface, first and second inner diameters defined on the inner surface, a tapered shoulder extending radially inwardly from the first to the second diameter, the helical thread formed on the first inner diameter so that rotation of the first plug seat during drillout urges the first plug seat into the tapered shoulder.

Embodiment 20. The downhole tool of any of embodiments 15-19, the first plug seat comprised of a phenolic material with fabric reinforcing material embedded therein.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more cement compositions, flow ports, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A downhole apparatus comprising:

a sleeve body, the sleeve body defining a sleeve body inner surface, the inner surface of the sleeve body defining first and second inner diameters and a tapered shoulder extending radially inwardly from the first to the second inner diameter;

an internal thread on a threaded portion of the sleeve body inner surface, the internal thread defining a thread minor diameter; and a plug seat having an unthreaded outer surface defining a plug seat outer diameter that is greater than the thread minor diameter, the unthreaded outer surface of the plug seat being pressed into the threaded portion of the sleeve body inner surface, wherein rotation of the plug seat after the plug seat is pressed into the sleeve body urges the plug seat in a direction toward the tapered shoulder.

2. The downhole apparatus of claim 1, the thread defining a sharp point at the crest thereof.

3. The downhole apparatus of claim 1, wherein the thread grippingly engages the plug seat.

4. The downhole apparatus of claim 1, the thread having first and second flanks, one of the first and second flanks defining an angle with the sleeve body inner surface of between about 80° and 110°, the internal thread having a sharp point at the crest thereof.

5. The downhole tool of claim 1, the sleeve body and plug seat being made from dissimilar materials.

6. The downhole tool of claim 5, the plug seat made from a material having greater ductility than the sleeve body.

7. A downhole tool comprising:

a tool body; and an operating sleeve detachably connected and movable in the tool body, the operating sleeve comprising:

an operating sleeve body having an upper end and a lower end;

a plug seat anchor comprising a helical thread on the inner surface of the operating sleeve body, the plug seat anchor defining an anchor diameter that comprises the minor diameter of the helical thread, wherein the helical thread grips the outer surface of the plug seat; and a plug seat inserted in an interference fit into the plug seat anchor of the operating sleeve body, the plug seat having a smooth, threadless outer surface defining an outer diameter that is greater than the anchor diameter, wherein the plug seat anchor grippingly engages the smooth, threadless outer surface of the plug seat to reduce rotation between the operating sleeve body and the plug seat when a rotational force is applied to the plug seat to drill the plug seat out of the operating sleeve body, wherein the operating sleeve body defines a first cylindrical portion with a first inner diameter and a second cylindrical portion with a second inner diameter and defines a shoulder that tapers radially inwardly from the first to the second cylindrical portions, and wherein the rotational force urges the plug seat into the tapered shoulder.

8. The downhole tool of claim 7, the plug seat made from a material having more ductility than the operating sleeve body.

9. The downhole tool of claim 7, the thread form of the helical thread comprising a V-shaped thread with a sharp crest.

10. The downhole tool of claim 9, wherein the lead angle of the V-shaped thread is in the range of about 105° to 135°.

11. The downhole tool of claim 7, wherein the helical thread bites into the outer surface of the plug seat.

12. A downhole tool comprising:

a tool body; and a first operating sleeve disposed in and movable relative to the tool body, the first operating sleeve comprising:

a first operating sleeve body, the first operating sleeve body having a helical thread on an inner surface thereof, the helical thread defining a first helical thread inner diameter; and a first plug seat defining a generally cylindrical threadless outer surface with a first plug seat outer diameter, the first plug seat pressed into the first operating sleeve body in an interference fit with the helical thread on the first operating sleeve body, the helical thread on the first operating sleeve body thread cutting into the first plug seat when the first plug seat is in a fully inserted position; the first operating sleeve body comprising:

an inner surface;

first and second inner diameters defined on the inner surface;

a tapered shoulder extending radially inwardly from the first to the second diameter; and the helical thread formed on the first inner diameter of the first operating sleeve body so that rotation of the first plug seat during drillout urges the first plug seat into the tapered shoulder.

13. The downhole tool of claim 12 further comprising a setting sleeve disposed about the tool body connected to the first operating sleeve with a plurality of shearable drive pins, the setting sleeve being movable downwardly with the first operating sleeve.

14. The downhole tool of claim 12 further comprising a second operating sleeve detachably connected in the tool body, the second operating sleeve comprising:

a second operating sleeve body, the second operating sleeve body having a helical thread on an inner surface thereof, the helical thread defining a second helical thread inner diameter; and a second plug seat defining a generally cylindrical threadless outer surface with a second plug outer diameter, the second plug seat pressed into the second operating sleeve body in an interference fit with the helical thread on the second operating sleeve body, the helical thread on the second operating sleeve body cutting into the second plug seat when the second plug seat is in a fully inserted position.

15. The downhole tool of claim 14, the first and second plug seats comprised of drillable materials, wherein the engagement of the first and second helical threads with the first and second plug seats respectively helps to prevent relative rotation between the first and second plug seats and the first and second sleeve bodies during drillout of the first and second plug seats.

16. The downhole tool of claim 12, the first plug seat comprised of a phenolic material with fabric reinforcing material embedded therein.

* * * * *